United States Patent [19]

Kelleher

[11] 4,000,056

[45] Dec. 28, 1976

[54] APPARATUS FOR ELECTROLYTIC METAL RECOVERY

[75] Inventor: Richard F. Kelleher, Guelph, Canada

[73] Assignee: Electrolyte Services Ltd., Guelph, Canada

[22] Filed: Jan. 20, 1975

[21] Appl. No.: 542,548

Related U.S. Application Data

[63] Continuation-in-part of Ser. No. 402,210, Oct. 1, 1973, abandoned.

[52] U.S. Cl. ..... 204/272; 204/275; 204/284; 204/293

[51] Int. Cl.[2] ..... C25C 7/02; C25C 5/02

[58] Field of Search ..... 204/272, 275, 263, 269, 204/284, 259, 293

[56] References Cited

UNITED STATES PATENTS

| | | | |
|---|---|---|---|
| 1,547,362 | 7/1925 | Casale | 204/272 |
| 1,857,224 | 5/1932 | Webber et al. | 204/263 |
| 3,702,814 | 11/1972 | Mandroian | 204/272 |

*Primary Examiner*—R. L. Andrews
*Attorney, Agent, or Firm*—Sim & McBurney

[57] ABSTRACT

This invention provides an apparatus for recovering a metal such as silver from an electrolyte in which the metal is dissolved. Into an open-topped tank is placed a close-fitting sleeve- or basket-like reticulum, of a material such as stainless steel screening. The reticulum includes vertical cylindrical sleeves and an electrode is centrally suspended within each sleeve. A voltage differential is applied between the reticulum and sleeve on the one hand and the electrode(s) on the other hand. The electrolyte is gradually introduced into the tank near the bottom inside the screen-like reticulum, and exit means are provided near the top of the open-topped tank through which the electrolyte can be drained off.

7 Claims, 4 Drawing Figures

APPARATUS FOR ELECTROLYTIC METAL RECOVERY

This application is a continuation-in-part of U.S. patent application Ser. No. 402,210, entitled "Method And Apparatus For Electrolytic Metal Recovery", filed on Oct. 1, 1973, now abandoned.

This invention relates generally to the electrolytic recovery of a metal from a solution in which the metal is dissolved, and has to do particularly with a method and apparatus for the electrolytic recovery of silver from a silver-bearing solution.

SUMMARY OF THE PRIOR ART

It is known in the prior art that the recovery of a dissolved metal from an electrolytic solution may be accomplished by providing, suspended in the solution, a perforated basket-type cathode and one or more vertical anode bars adjacent to but spaced from the cathode wall. When the necessary voltage differential is applied between the anode and the cathode, the dissolved metal will tend to plate out on the cathode.

In one particular prior art patent, such a basket-type cathode is constructed of perforated sheet iron fitting within a tank intended to contain the electrolyte, the cathode having the equivalent of a bottom wall spanning across and vertically beneath the anode bars. However in the prior art patent under discussion, the perforations in the side and bottom walls of the basket-type cathode are said to be such as to permit at all times the passage of cell effluent therethrough.

A major drawback of the prior art patent just described is the fact that the perforations in the bottom wall of the basket-type cathode, because they are intended to remain open at all times to permit the passage of effluent out of the cell, also are incapable of preventing the loss of any small bits of the plated metal that may have broken free from other portions of the cathode. Because of the flow contours of the above-described prior art patent, there will be a natural tendency for the effluent to sweep any such bits of free metal out through the perforations, and this will represent an economic loss, particularly where the metal being electrolytically removed from the solution is a precious metal like gold or silver.

OBJECTS OF THIS INVENTION

In view of the drawbacks of the prior art as described briefly above, it is an object of this invention to provide a method and apparatus for the electrolytic recovery of a metal from a solution, such that the risk of metal loss due to plated metal breaking free from any portion of the cathode is minimized.

GENERAL DESCRIPTION OF THE INVENTION

Accordingly, this invention provides an apparatus for recovering a metal from an electrolyte in which the metal is dissolved, said apparatus comprising: an open-topped container having a bottom and lateral sides, a liquid-permeable, electrically conductive reticulum adjacent said sides within said container; at least one open-ended electrically conductive, reticulated sleeve portion within, and in electrical communication with, said reticulum; at least one electrode centrally suspended within said sleeve portion; means for applying a voltage differential between said sleeve portion and said electrode; means for introducing the electrolyte into the container near the bottom thereof; and means for removing the electrolyte from the container remote from the bottom thereof.

In one embodiment, this invention provides an apparatus for recovering silver from a solution of sodium thiosulphate in which silver is dissolved, said apparatus comprising: an open-topped container having an outlet adjacent the top thereof, a liquid-permeable reticulum of stainless steel screen within said container, the reticulum including a plurality of upstanding side panels, a plurality of open-ended stainless steel screen cylinders arranged vertically within said reticulum and attached thereto to achieve electrical contact therewith, an electrode centrally within but out of direct contact with each cylinder, means for applying a voltage differential between said reticulum and said electrodes, and a tube extending downwardly within said reticulum to a location adjacent the bottom of the container for delivering said solution to the container.

GENERAL DESCRIPTION OF THE DRAWINGS

Two embodiments of this invention are shown in the accompanying drawings, in which like numerals denote like parts throughout the several views, and in which.

Figure 1:
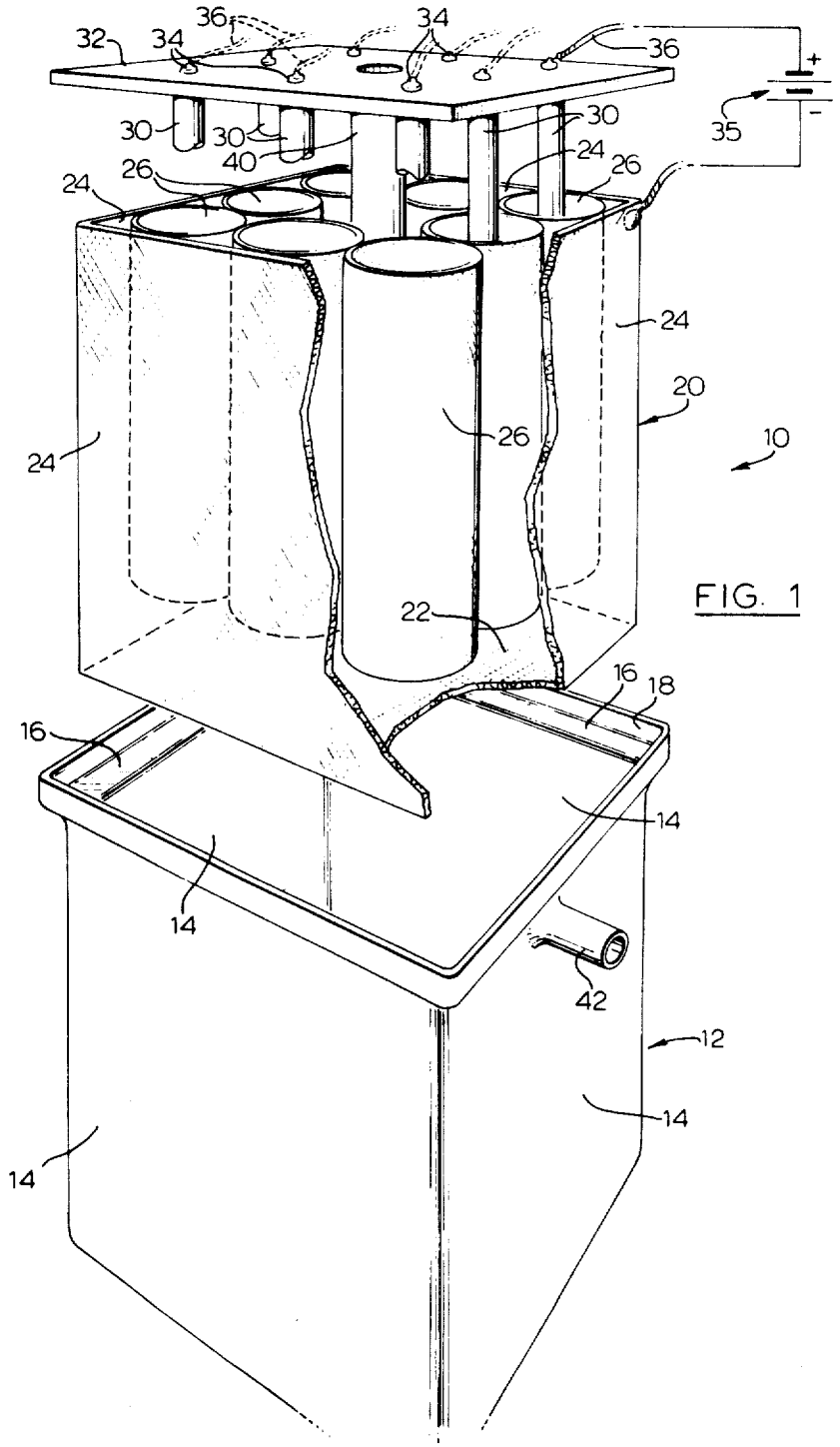
FIG. 1 is a partly broken-away, exploded, perspective view of an apparatus constructed in accordance with one embodiment of this invention.

PARTICULAR DESCRIPTION OF THE DRAWINGS:

Attention is first directed to FIG. 1, in which an electrolytic cell apparatus generally designated by the numeral 10 is seen to include an open-topped container 12 having four upstanding rectangular side walls 14 and a bottom wall which is hidden from view in FIG. 1. In the particular embodiment shown, the container 12 is substantially square in horizontal section, although this is not essential to the invention.

Figure 2:
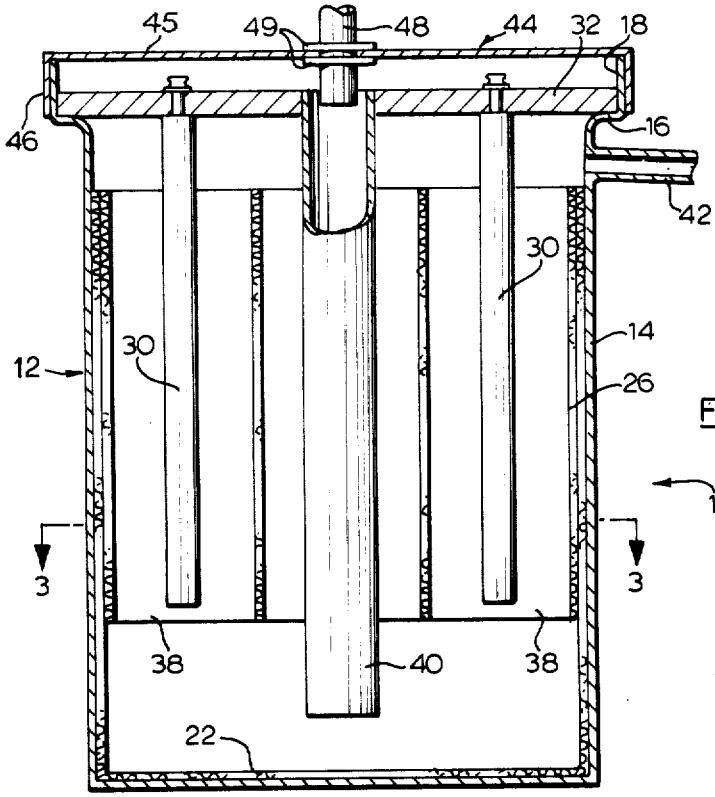
FIG. 2 is a central, vertical sectional view of the apparatus of FIG. 1 in the assembled condition.

Along and around the upper edges of the side walls 14 is a stepped ledge 16 merging with an upstanding rim 18. The configuration of the ledge 16 and rim 18 for the particular embodiment shown is best seen in FIG. 2.

The electrolytic cell apparatus 10 further includes a liquid-permeable, electrically conductive reticulum 20 which in FIG. 1 is of basket configuration and which is adapted to fit complementally within the container 12. Throughout this specification and in the appended claims, the word "reticulum" is intended to refer to a liquid-permeable, net-like or screen-like member in which the individual pours are small enough that they may be completely blocked or closed by the accumulating deposition of metal during the plating process.

The basket-like reticulum 20 is shown to include a bottom panel 22, and four upstanding side panels 24. In the configuration shown, wherein the container 12 is substantially in the shape of a rectangular parallelepiped, the basket-like reticulum 20 will be such that the bottom panel 22 and the four side panels 24 are all rectangular in configuration.

When utilizing the apparatus of this invention for the recovery of silver from sodium thiosulphate, it is preferable that the basket-like reticulum be constructed of stainless steel, for reasons which will appear hereinafter.

Within and bonded to the basket-like reticulum 20 are eight open-ended, electrically conductive, reticulated sleeve portions 26 which are vertically situated within the basket-like reticulum 20 and which extend from a location substantially even with the top of the reticulum 20 to a location intermediate the top and bottom of the reticulum 20. Preferably, the sleeve portions 26 are made from the same liquid-permeable material as is the reticulum 20 itself, and in the preferred embodiment of this apparatus, particularly useful for the electrolytic recovery of silver from a solution of sodium thiosulphate, the sleeve portions 26 are constructed of stainless steel screen.

Figure 3:
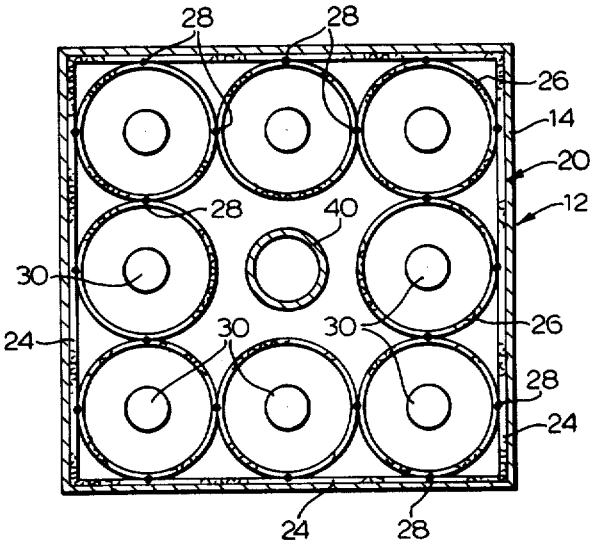
FIG. 3 is a horizontal sectional view taken at the line 3—3 in FIG. 2.

Attention is directed now to FIG. 3, for a better appreciation of the geometric relationship of the sleeve portions 26 with respect to the square cross-section reticulum 20. As can be seen, each sleeve portion 26 has a diameter approximately equal to one third of the side dimension of the reticulum 20, whereby three sleeve portions 26 may be positioned in alignment along each side panel 24 of the reticulum 20. Using this arrangement, there is thus room for eight sleeve portions 26, omitting a sleeve portion from the very centre of the reticulum 20.

All of the sleeve portions 26 are preferably bonded or otherwise secured to the reticulum 20 in such a way that electrical communication takes place between them. In the preferred embodiment the bonding is accomplished by welding, and in FIG. 3 the welding spots are shown by dots 28. The dots 28 in FIG. 3 actually represent a line contact either between two sleeve portions 26 or between a sleeve portion 26 and a side panel 24 of the reticulum 20. The welding can take place at discrete separated locations along these lines of contact, or may be a continuous weld along the line of contact.

Referring now to FIGS. 1 to 3, there is provided a plurality of electrodes 30, eight in number in the particular configuration shown, so arranged that each electrode 30 extends downwardly and centrally within one of the sleeve portions 26. This is particularly well shown in FIGS. 1 and 3.

Conveniently, the eight electrodes shown in the drawings are attached at their upper ends to, and therefore suspended from, a closure plate 32 of essentially rectangular configuration, adapted to seat snugly but removably upon the stepped ledge 16 within the rim 18, as shown in FIG. 2. The electrodes 30 may be of any suitable anodic material, such as graphite.

As seen in FIG. 1 and FIG. 2, each electrode 30 is associated with and in electrical contact with a terminal 34, and all eight electrodes in the embodiment illustrated are connected to the positive side of a D.C. source such as a battery 35 (shown schematically only in FIG. 1). Wires 36 are employed to make the electrical connection between the positive terminal of the battery 35 and the electrode terminals 34.

As particularly seen in FIG. 2, when the closure plate 32 seats firmly against the stepped ledge 16, the electrodes 30 extend downwardly to a location near or at the bottom ends 38 of the sleeve portions 26. The termination of the electrodes 30 in the general location of the bottom ends 38 of the sleeve portions 26 is the preferred construction, but is not considered essential to the invention.

A vertically oriented tube 40 secured at its upper end to the closure plate 32 provides a means for introducing the electrolyte into the container 12 within the basket-like reticulum 20 near the bottom end thereof. Preferably, the tube 40 is situated centrally of the closure plate 32 and therefore extends down the central axis of the basket-like reticulum 20 and of the container 12. As particularly well seen in FIG. 2, the tube 40 terminates closely adjacent to, but out of contact with, the bottom panel 22 of the basket-like reticulum 20.

The tube 40 thus constitutes the inlet tube for the electrolytic solution, and the apparatus also includes an outlet tube 42 communicating through one of the side walls 14 adjacent the top of the container 12.

The general flow of electrolyte through the apparatus 10 as pictured in FIG. 2, is down the tube 40, into the lower portion of the container 12 within the reticulum 20, upwardly around the tube 40 and through the sleeve portions 26 (where the major portion of the electrolytic plating operation will take place), and finally out of the container 12 through the outlet tube 42.

FIG. 2 shows the provision of a cap member 44 including a rectangular plate portion 45 and downwardly depending edge walls 46. As can be seen in FIG. 2, the cap member 44 forms a close fit around the rim 18 of the container 12. Extending centrally through the rectangular plate portion 45 of the cap member 44 is the end of a delivery tube 48, the delivery tube 48 being secured in position through the rectangular plate portion 45 by virtue of two tight fitting washer members 49.

The method of this invention as it relates to the first embodiment shown in FIGS. 1 to 3, and as directed to the electrolytic recovery of silver from a solution of sodium thiosulphate, includes these steps: The basket-like reticulum 20 is first inserted in the container 12, following which the closure plate 32 with its suspended electrodes 30 is fitted into and against the stepped ledge 16 such that the electrodes 30 extend centrally downwardly within the sleeve portions 26 of the basket-like reticulum 20. The electrolyte is then passed into the container 12 through first the delivery tube 48 and then the tube 40, gradually filling up the container 12 to the level of the outlet tube 42, which acts in the manner of a weir. Simultaneously with the filling up of the container 12, the requisite voltage differential is applied between the reticulum 20 and the plurality of electrode 30 in such a way as to cause the electrodes to become anodic with respect to the reticulum 20, thereby initiating the continuous process of plating silver on both the sleeve portions 26 and the other portions of the reticulum proper.

The sodium thiosulphate electrolyte is continuously passed through the container 12 in the preferred method, and the plating out of silver on all parts of the reticulum and the sleeve portions 26 will gradually take place. Because of the greater proximity of the electrodes to their respective sleeve portions 26, the greater amount of the plated-out silver will collect on the sleeve portions 26 and on those parts of the reticulum 20 that are immediately adjacent the sleeve portions 26. However, a certain amount of plated out silver will, in the first embodiment, collect on the bottom panel 22 and the lower portions of the side panels 24, especially in view of the fact that the sodium thiosulphate electrolyte immediately adjacent the bottom panel 22 is particularly rich in dissolved silver content, having just been admitted to the container 12 at this location. Because of the higher concentration of dissolved silver at the lower end of the container 22, there will be an increased tendency for silver to plate out on the bottom panel 22, despite the fact that the anodic electrodes 30 are spaced some distance away from the bottom panel 22. As the electrolytic operation proceeds, more and more silver will plate out on the bottom panel 22 (as well as on other parts of the reticulum 20 and the sleeve portions 26), and in time the openings or perforations in the bottom panel 22 will be substantially completely blocked or closed by the deposited plated-out silver. By the time the openings in the bottom panel 22 are substantially completely blocked, the amount of silver collecting on the sleeve portions 26 above the bottom panel 22 will be reaching the stage where there is increased risk of plated-out silver breaking off or otherwise becoming detached from the sleeve portions 26. Because of the density of elemental silver, one can arrange for a relatively slow throughput of the electrolyte moving upwardly, so that the silver particles that may break free from the sleeve portions 26 will fall downwardly under gravitation against the upwardly moving electrolyte, and will collect against the now substantially closed and imperforate bottom panel 22 of the basket-like reticulum 20. At any time after the substantial amounts of silver have collected on the bottom panel 22 of the basket-like reticulum 20, the electrolytic operation may be suspended by halting the feed of electrolyte and disconnecting the voltage potential.

At this stage, a considerable amount of silver may have plated out on the reticulum 20 and the sleeve portions 26, and a certain amount may be lying in the form of free particles against the bottom panel 22.

In order to reclaim the silver from the reticulum 20, one of three methods may be employed. In the first method, the reticulum 20 is removed from the container 12 (after the prior removal of the cap member 44 and the closure plate 32 together with its attached electrodes 30), and is simply heated either in a furnace or in an open area to a temperature in the range of 1,000° F, at which temperature the elemental silver will melt and run off into a suitable collection location. Where the method of this invention is used to recover silver from a solution, and where the reticulum and sleeve portions are made of stainless steel screening, the above-mentioned temperature of 1,000° F will not melt the stainless steel, and the reticulum together with the sleeve portions can be simply re-inserted into the container 12 and used again.

The second method for removing the plated-out silver from the reticulum 20 and the sleeve portions 26 is to remove the latter from the container 12 and then insert it into a different electrolytic cell having an acid electrolyte and silver electrodes extending centrally downwardly within the sleeve portions 26 in substantially the same arrangement as shown in FIG. 2. In this case, however, the polarity would be reversed, such that the reticulum 20 and the associated sleeve portions 26 were made anodic with respect to the central electrodes, which would be cathodic, and which preferably would be made of pure silver. By the latter process, what is known as "needle silver" (very high purity) would be plated onto the silver cathodes.

The third method for removing the plated-out silver from the reticulum 20 and the sleeve portions 26 is by simple scraping or high-pressure water blast. The silver tends to plate onto the screen mesh of the sleeve portions 26 as a spongy, foraminated mass, rather than as a solid plate, and as such it is possible to remove it from the mesh either by simple scraping or by water spray. The silver plated on the bottom panel 22 can also be removed in this way, because although the silver on the bottom panel 22 tends to be evenly distributed so as to close the perforations of the bottom panel 22, it is nonetheless not so strongly bonded thereto that it cannot be removed by the mechanical act of scraping or spraying. In tests conducted during the development of the apparatus according to this invention, it was found that virtually all of the silver so collected could be removed by scraping or spraying.

Figure 4:
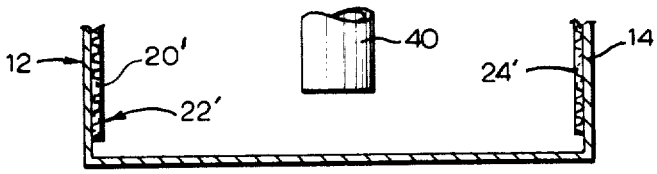
FIG. 4 is a partial vertical section of another embodiment of this invention.

Attention is now directed to FIG. 4 of the drawings which shows, partially broken away, the other embodiment of this invention. The missing portion in FIG. 4 is identical to the upper part of FIG. 2. The difference between the FIG. 4 embodiment and that shown in FIG. 2 is that there is no bottom panel 22 in the reticulum 20'. Aside from the absence of a bottom panel, however, the reticulum 20' in FIG. 4 is identical to the reticulum 20 in FIG. 2. Thus, the sectional view of FIG. 3 also applies to the FIG. 4 embodiment.

The method of operation of this invention as it relates to the second embodiment thereof, shown in FIG. 4, includes the same initial steps as that related to the FIG. 2 embodiment. Taking the specific case of the electrolytic recovery of silver from a solution of sodium thiosulphate, the method includes the steps of inserting the reticulum 20' into the container 12, fitting the closure plate 32 into and against the stepped ledge 16 so that the electrodes 30 extend centrally downwardly within the sleeve portions 26 (these latter elements are the same in both embodiments), and then passing the sodium thiosulphate electrolyte into the container 12 along the tube 40. The electrolyte gradually fills up the container 12 to the level of the outlet tube 42, and upon filling the container the requisite voltage differential is applied between the reticulum 20' and the plurality of electrodes 30 in such a way as to cause the electrodes to become anodic with respect to the reticulum 20', thereby initiating the continuous process of plating silver on both the sleeve portions 26 and the outer portions of the reticulum 20'.

Because there is no bottom panel in the reticulum 20', the silver plating out at the lower end of the reticulum 20' will all occur on the side panels 24' of the reticulum 20', and there will be no "plating out" as such against the bottom of the container 12 due to the absence of polarity there.

When the plating process has reached the point where particles of plated silver may break off and come loose from the reticulum 20', such free particles will simply drift downwardly under the action of gravity and accumulate on the bottom wall of the container 12. The method of this invention as it pertains to the FIG. 4 embodiment includes the provision that the upward movement of the electrolyte through the container 12 is sufficiently slow to permit free silver particles to settle downwardly under gravitation against the upwardly moving electrolyte. In this way, there is no risk that free silver particles will be carried up and outwardly through the outlet tube 42.

The methods for removing plated out silver from the reticulum 20 described with respect to the FIG. 2 embodiment apply equally to the FIG. 4 embodiment, and need not be repeated here. With regard to any free silver particles that may have accumulated against the bottom wall of the container 12, these are simply dumped out of the container after the reticulum 20 has been removed and the electrolyte has been poured out.

What I claim is:

1. Apparatus for recovering a metal from an electrolyte in which the metal is dissolved, said apparatus comprising:

an open-topped container having a bottom and lateral sides, a liquid-permeable, electrically conductive reticulum inwardly adjacent said sides within said container, and running in uninterrupted fashion around the inside of the container, at least one open-ended electrically conductive reticulated sleeve portion within, and in electrical communication with, said reticulum, at least one electrode centrally suspended within said sleeve portion, means for applying a voltage differential between said sleeve portion and said electrode, means for introducing the electrolyte into the container near the bottom thereof, and means for removing the electrolyte from the container remote from the bottom thereof.

2. The invention claimed in claim 1, in which said at least one reticulated sleeve portion is cylindrical and is vertically oriented within said reticulum, and in which said means for introducing includes a tubular member extending downwardly from the open top of the container within said reticulum to a location adjacent the bottom of the container.

3. The invention claimed in claim 2, in which there are a plurality of sleeve portions, each having an electrode centrally suspended within it.

4. The invention claimed in claim 2, in which said means for removing includes an outlet in said container adjacent the top thereof.

5. The invention claimed in claim 1, in which said reticulum and said sleeve portion are both made of stainless steel screen, and in which the reticulum includes a bottom panel, whereby the reticulum is of basket configuration.

6. The invention claimed in claim 1, in which the open-topped container is substantially a rectangular parallelepiped with a flat rectangular bottom wall and four upstanding rectangular side walls, said outlet being located in one side wall at a point spaced above said bottom wall, and in which said reticulum is shaped to fit complementally within said container and includes a rectangular bottom panel and four upstanding rectangular side panels, all said panels being of stainless steel screening, and in which there are a plurality of sleeve portions of stainless steel screening, each sleeve portion being cylindrical, vertically oriented, and extending between the top of said reticulum and a location intermediate said top and said rectangular bottom panel.

7. Apparatus for recovering silver from a solution of sodium thiosulphate in which silver is dissolved, said apparatus comprising:

an open-topped container having an outlet adjacent the top thereof, a liquid-permeable reticulum of stainless steel screen within said container, the reticulum including a plurality of upstanding side panels, a plurality of open-ended stainless steel screen cylinders arranged vertically within said reticulum and attached thereto to achieve electrical contact therewith, an electrode centrally within but out of direct contact with each cylinder, means for applying a voltage differential between said reticulum and said electrodes, and a tube extending downwardly within said reticulum to a location adjacent the bottom of the container for delivering said solution to the container.

* * * * *